US011491355B1

(12) United States Patent
Millard

(10) Patent No.: US 11,491,355 B1
(45) Date of Patent: Nov. 8, 2022

(54) RESPIRATION FLOW APPARATUS

(71) Applicant: Mark Hammond Millard, Traverse City, MI (US)

(72) Inventor: Mark Hammond Millard, Traverse City, MI (US)

( * ) Notice: Subject to any disclaimer, the term of this patent is extended or adjusted under 35 U.S.C. 154(b) by 0 days.

(21) Appl. No.: 17/515,582

(22) Filed: Nov. 1, 2021

(51) Int. Cl.

| | |
|---|---|
| ***A62B 9/02*** | (2006.01) |
| ***A62B 9/04*** | (2006.01) |
| ***A62B 7/10*** | (2006.01) |
| ***A41D 13/11*** | (2006.01) |
| ***A62B 18/08*** | (2006.01) |
| ***A62B 18/02*** | (2006.01) |
| ***A62B 9/00*** | (2006.01) |

(52) U.S. Cl.
CPC ..... *A62B 9/003* (2013.01); *A41D 13/1107* (2013.01); *A41D 13/1161* (2013.01); *A62B 7/10* (2013.01); *A62B 9/02* (2013.01); *A62B 9/04* (2013.01); *A62B 18/025* (2013.01); *A62B 18/08* (2013.01)

(58) Field of Classification Search
CPC .. A62B 9/003; A62B 7/10; A62B 9/02; A62B 9/04; A62B 9/06; A62B 18/00; A62B 18/006; A62B 18/02; A62B 18/025; A62B 18/04; A62B 18/045; A62B 18/06; A62B 18/08; A62B 18/10; A41D 13/1107; A41D 13/1161; A61M 16/06
See application file for complete search history.

(56) References Cited

U.S. PATENT DOCUMENTS

| | | | | |
|---|---|---|---|---|
| 1,395,948 A | | 11/1921 | Bernhard | |
| 1,978,994 A | * | 10/1934 | Fortunato | A62B 18/04 128/206.29 |
| 2,383,649 A | * | 8/1945 | Heidbrink | A62B 18/08 128/206.29 |
| 2,521,084 A | * | 9/1950 | Oberto | A61M 16/06 128/206.29 |
| 2,857,911 A | * | 10/1958 | Bennett | A61M 16/0493 128/207.14 |

(Continued)

FOREIGN PATENT DOCUMENTS

| | | | | |
|---|---|---|---|---|
| CN | 211751661 U | | 10/2020 | |
| KR | 200480161 Y1 | * | 4/2016 | A62B 18/02 |

(Continued)

OTHER PUBLICATIONS

English translation for KR 200480161, translated on Jul. 7, 2022, translated by SEARCH through clarivate analytics.*

(Continued)

*Primary Examiner* — Tu A Vo
(74) *Attorney, Agent, or Firm* — Precipice IP PLLC; Angela J. Grayson

(57) ABSTRACT

A ducted breathing apparatus and methods for assembling and using such ducted breathing apparatus are provided. The ducted breathing apparatus may include a face cover for sealing at least a portion of a user's face. The ducted breathing apparatus may include a ducted air channel element for providing direct air flow from a user's mouth within the mask to the outside environment. The ducted breathing apparatus may include a coupling element for providing a sealed mating connection between the ducted air channel element and the face cover.

7 Claims, 14 Drawing Sheets

(56) References Cited

U.S. PATENT DOCUMENTS 4,029,092 A * 6/1977 Morgan ..... A62B 18/02 128/206.29
4,164,218 A * 8/1979 Martin ..... A62B 7/08 128/201.18
4,207,882 A * 6/1980 Lemere ..... A62B 18/00 2/9
4,231,359 A * 11/1980 Martin ..... A62B 17/04 128/206.29
4,452,240 A * 6/1984 Moretti ..... A62B 17/04 128/201.28
4,470,413 A * 9/1984 Warncke ..... A62B 18/084 128/206.29
4,573,463 A * 3/1986 Hall ..... A62B 18/025 128/206.28
4,614,186 A * 9/1986 John ..... A62B 17/04 128/201.25
4,674,492 A * 6/1987 Niemeyer ..... A62B 9/006 128/206.17
4,706,683 A * 11/1987 Chilton ..... A61M 15/02 128/203.29
4,890,609 A * 1/1990 Wilson, II ..... A61M 16/06 128/206.28
4,955,373 A 9/1990 Maguire, III
5,086,768 A * 2/1992 Niemeyer ..... A62B 23/02 128/206.16
5,186,165 A * 2/1993 Swann ..... A62B 17/04 128/201.28
5,431,158 A * 7/1995 Tirotta ..... A61M 16/0488 128/207.14
5,645,046 A 7/1997 Kay
5,732,695 A 3/1998 Metzger
6,041,778 A * 3/2000 Swann ..... A62B 7/04 128/205.12
6,302,103 B1 * 10/2001 Resnick ..... A62B 9/06 128/206.28
6,460,539 B1 10/2002 Japuntich et al.
6,584,975 B1 7/2003 Taylor
6,701,925 B1 * 3/2004 Resnick ..... A62B 17/04 128/205.27
7,100,611 B2 * 9/2006 Yu ..... A61M 16/06 128/206.28
7,559,323 B2 7/2009 Hacke et al.
8,342,179 B2 1/2013 Hacke et al.
8,496,004 B2 7/2013 Lang et al.
9,084,905 B2 7/2015 Campbell
9,833,645 B2 12/2017 Jones
10,183,138 B2 1/2019 Ng et al.
10,589,079 B2 3/2020 Linton
10,758,696 B2 9/2020 Frater et al.
10,905,905 B1 * 2/2021 Dettore ..... A62B 23/025
2002/0170563 A1 11/2002 Japuntich et al.
2003/0234016 A1 * 12/2003 Swann ..... A62B 23/02 128/201.25
2005/0028811 A1 * 2/2005 Nelson ..... A61M 16/107 128/200.11
2010/0122699 A1 * 5/2010 Birnkrant ..... A61M 16/0006 128/205.12
2011/0277768 A1 * 11/2011 Hill ..... A62B 7/10 128/205.28
2013/0097769 A1 * 4/2013 Tuffery ..... A62B 17/006 2/456
2017/0100613 A1 * 4/2017 Chessari ..... A62B 7/10
2017/0136271 A1 * 5/2017 Munster ..... A62B 7/10
2018/0064967 A1 * 3/2018 Brookes ..... A62B 7/12
2018/0110945 A1 * 4/2018 Cheng ..... A41D 13/11
2019/0374797 A1 12/2019 Jones

FOREIGN PATENT DOCUMENTS

KR 200480161 Y1 4/2016
WO WO-2013056390 A1 * 4/2013 ..... A61M 16/0493
WO WO-2021240841 A1 * 12/2021
WO WO-2022008766 A1 * 1/2022

OTHER PUBLICATIONS

ISR/WO International Application No. PCT/US2021/057783; Date of mailing Mar. 15, 2022; International filing date Nov. 2, 2021; 11 pages.

* cited by examiner

RESPIRATION FLOW APPARATUS

CROSS-REFERENCE TO RELATED APPLICATION

This application claims the benefit of U.S. Provisional Patent Application No. 63/109,126, filed Nov. 3, 2020, which is incorporated by reference herein in its entirety.

BACKGROUND

Field

The present disclosure relates to the field of respirators and face masks.

Background

Face masks and respirators are employed to filter the air inhaled by a user in conditions warranting protection including environments such as medical settings, hazardous industrial areas, or in-door and outdoor spaces shared with other occupants during infectious pathogen outbreaks. Respirators include a face mask which covers the nose and mouth of the user, and optionally the eyes and ears. Designs for face masks vary from the simple cloth covering to those having multiple inlet and outlet valves working in conjunction with filter elements for filtering air when the user inhales and exhales. Generally, masks block contaminants from the outside air, with some masks including filtration devices with better capabilities for blocking the undesirable contaminants.

These conventional masks and respirators have drawbacks. The interior of the masks forms an open cavity where stale air lingers around the user's face. Users experience discomfort from the warm stale air. In cases where the user requires eyeglass/eye protection usage, the warm humid exhalation expelled from the mask cavity may cause fogging of the eyeglass.

Accordingly, there is an opportunity to improve on the existing mask designs to provide better functionality and comfort for the users.

SUMMARY

In an aspect of the disclosure, a ducted breathing apparatus is provided. The ducted breathing apparatus may include a face cover for sealing at least a portion of a user's face. The ducted breathing apparatus may include a ducted air channel element for providing direct air flow from a user's mouth within the mask to an environment outside the mask cavity. The ducted breathing apparatus may include a coupling element for providing a sealed mating connection between the ducted air channel element and the face cover. One concept of the disclosure may be to have the option of exhaled respiration to be ducted through a breathing cavity and dispersed to the outside environment while minimizing cross contamination between inhaled and exhaled respiration from mouth or nose or both mouth and nose thus improving many facets of the current technology.

Another concept may be designing a unit that can be recyclable and reusable to limit costs and waste to current technology.

In another aspect of the disclosure, a method for assembling a ducted breathing apparatus is provided. The method may include providing a face cover for sealing at least a portion of a user's face. The method may include attaching a coupling element to the face cover, the coupling element configured to receive a ducted air channel element. The method may include attaching the ducted air channel element to the coupling element.

In another aspect of the disclosure, a method for breathing through a ducted breathing apparatus is provided. The method may include one of inhaling or exhaling through a ducted air channel element that is attached to a coupling element mated to a face cover, the coupling element having one of a friction surface connection, screw threads fusion, or adhesives.

In another aspect of the disclosure, a ducted breathing apparatus is provided. The ducted breathing apparatus includes a face cover for sealing at least a portion of a user's face. The ducted breathing apparatus includes a ducted air channel element for providing one-way direct air flow out from the user's mouth within the mask to the outside environment. The ducted breathing apparatus includes a coupling element for providing a sealed mating connection between the ducted air channel element and the face cover. The ducted breathing apparatus includes a heat shield to reduce heat transfer from an exhalation pathway defined by the one-way direct air flow directing exhalation heat away from the user, wherein the ducted air channel element in conjunction with the heat shield isolates the effects of exhalation on inhalation air supply.

DETAILED DESCRIPTION

Figure 1:
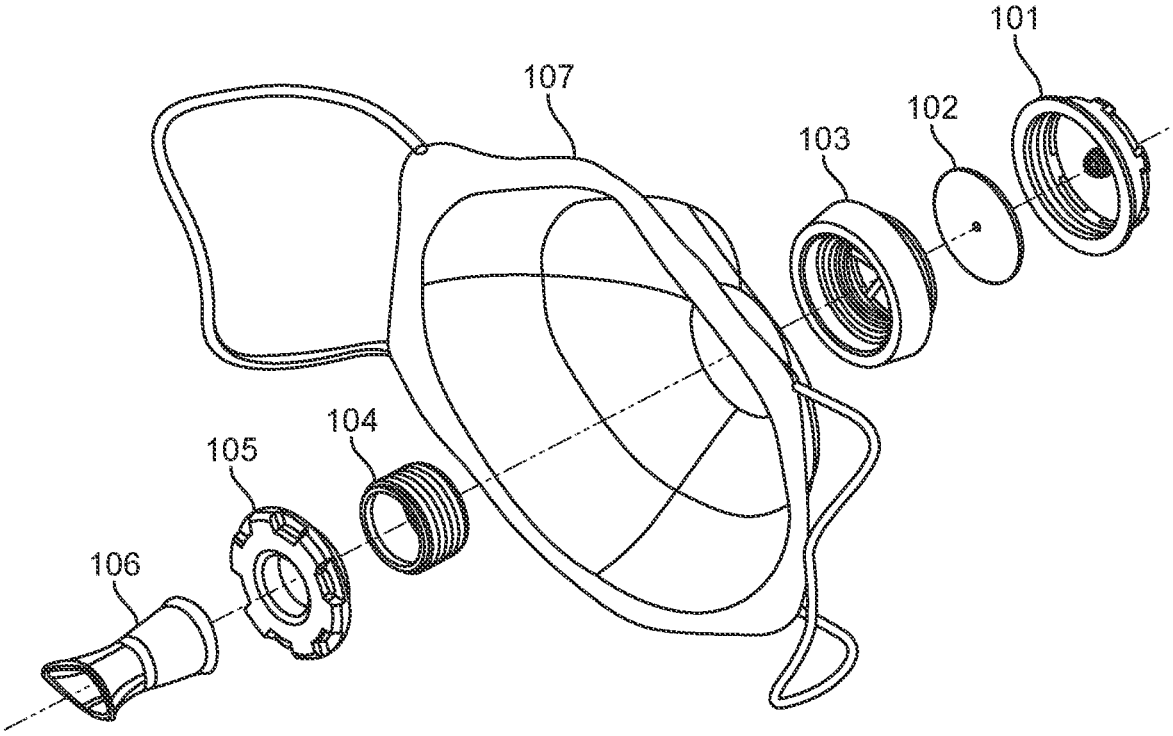
FIG. 1 is an exploded view of an example mask apparatus, illustrating upstream filtration with no downstream filtration, according to an embodiment of the disclosure

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. It will, however, be apparent to those skilled in the art that these concepts may be practiced without these specific details. In some instances, well known structures and components are shown in block diagram form in order to avoid obscuring such concepts. Descriptions of the shared components (e.g., with the same labels) between figures may be omitted for brevity.

Several aspects of the disclosure will now be presented with reference to various apparatuses and methods. These apparatuses and methods will be described in the following detailed description and illustrated in the accompanying drawings by various blocks, modules, components, steps, processes, etc. (collectively referred to as "elements"). While the methods may be described in an ordered series of steps, it will be apparent to those skilled in the art that the methods may be practiced in any operative order and each step may be practiced in various forms that are apparent to those skilled in the art.

One concept of infection control is to prevent, slow, or stop the spread of infections within a population by reducing exposure to pathogens. By preventing passage of viral particles into the body through the eyes, nose, and mouth, infections may be reduced. To this end, masks have been one important component in combating the spread of infectious and contagious pathogens. In addition, masks are used in environments with contaminants that may infect, contaminate, or irritate the user. A user breathing direct air flow inward, outward, or both through an enclosed air channel via a filter may be preferred to address these and other limitations of some mask designs. Direct air flow provides numerous benefits including reducing stagnant air, and aiding comfortable breathing due to non-heated humid air. Another advantage may include ensuring air is passed directly through the filter rather than through unfiltered side openings.

Proper use of mask respiratory protection reduces inhalation of aerosols and other air borne contaminates. When employees must work in environments with insufficient oxygen or where harmful dusts, fogs, smokes, mists, fumes, gases, vapors, or sprays are present, they need respirators. These health hazards may cause cancer, lung impairment, other diseases, or death. Due to the intense burden and discomfort the user feels of the utilized device, respiratory protection can be used unsafely, incorrectly or significantly decrease the time one is willing to utilize the equipment. With the apparatus attached to these respirator devices the performance and comfort is improved beyond current technology thus promoting the compliance of the users to wear the respiratory protection correctly and for longer periods of time. This improves the health of the user and the possibility of the non-user if utilizing equipment in an aerosolized virus environment.

Reduction of heat in the mask Cavity. Utilizing the apparatus, the effectiveness is increased for example of various embodiments of the present invention, a baffle element such as the baffle changed in shape or form is placed downstream or outside the exhalation valve orifice on the mask exterior so that particles in the exhale flow stream are collected by the baffle element after passing through the exhalation valve but before reaching the atmospheric air or exterior gas space. The baffle may configure to also be placed downstream to the exhalation valve so that any air passing through the exhalation valve subsequently impacts the impactor element and is diverted. The baffle element is constructed and arranged to obstruct the view of the valve orifice from the exterior to reduce the opportunity for splash fluids to pass through the valve. The baffle element may cover not only the valve and or valve cover but may also cover larger portions of the mask body to provide increased deflection of the exhale flow stream and particles and contaminants and increased obstruction to external contaminants. Apparatus improves the aerosol transmissible disease and airborne infection isolation AIIR airborne infection isolation room for both patient utilizing one of the apparatuses and the health care professional utilizing another form of the apparatus thus reducing the overall virus or infection rate of the room for aerosol transmission to others. Apparatus utilizing the fourth method allows the infected patient to exhale transmissible disease pathogens through the apparatus filtering system therefore reducing the overall transmissible disease in the room. Thus, if necessary due to limited supply the ability to increase the number of patients in a AIIR Room from one to more over what current technology could do. Under extreme scenarios such as a pandemic the ability to improve the breathing air for multiple patients to utilize the same area if needed greatly improves cost, overall wellness of patients and health care professionals, and reducing the continuation of spread of the transmissible disease.

Some terms common to the disclosure may include the follow. High-efficiency (HE) or high-efficiency particulate air (HEPA) filter: National Institute for Occupational Safety and Health (NIOSH) classification for a filter that is at least 99.97% efficient in removing particles and is used in powered air-purifying respirators (PAPRs). When high-efficiency filters are required for non-powered respirators, N100, R100, or P100 filters may be used. Hood: the portion of a respirator that completely covers the head and neck, and may also cover portions of the shoulders and torso, and through which clean air is distributed to the breathing zone. Loose-fitting facepiece: the portion of a respirator that forms a partial seal with the face but leaves the back of the neck exposed, is designed to form a partial seal with the face, and through which clean air is distributed to the breathing zone. N95 filter: a type of NIOSH-approved filter or filter material, which captures at least 95% of airborne particles. N95 respirator: a generally used term for a disposable air-purifying filtering facepiece respirator with NIOSH approved N95 particulate filter material. Elastomeric full face or half face air-purifying respirator in a reusable form with NIOSH approved N95 particulate filters or filter material (i.e., includes N95 filtering facepiece respirator or equivalent protection). Negative-pressure respirator: a tight-fitting respirator in which air is inhaled through an air-purifying filter, cartridge, or canister during inhalational efforts, generating negative pressure inside the facepiece relative to ambient air pressure outside the respirator.

FIG. 1 is an exploded view of an example mask apparatus, according to an embodiment of the disclosure. The mask apparatus may include a cover (or shield) that provides physical coverage for isolating the wearer's face, nose, and mouth from the outside environment. The face cover 107 may be a one-size-fits-all that is suitable for most or all people. In some embodiments, the face cover 107 may be specially design for each wearer. In other embodiments, the face cover 107 may be a filtered cup type respirator used to support the air channel. In other embodiments, the face cover 107 may take various forms and shapes. For example, some may optionally cover and isolate the eyes and ears. Mask, cover, and shield may be used interchangeable in the disclosure. Mask may refer to the entire assembly, or to the face cover/shield. 'Device' may refer to the entire assembly of the face mask including the components to add the ducting, heat shield ducting or air channel functionality, or 'device' may refer to the components to add the ducting, heat shield ducting or air channel functionality without the face mask.

One skilled in the art will readily recognize that the manner of providing air isolation to the nose, mouth (and optionally the eyes) may take various forms, and example embodiments are provided by way of example and not for limiting the applications of the disclosure. For example, the face cover 107 may include any suitable material, may include any suitable shape including partial or full-face masks including any size from smaller masks that wrap around only the nose and mouth to larger designs that cover the entire face or head.

The embodiments may be used for retrofitting existing designs or masks purchased off-the-shelf. Other embodiments may be used with specially design covering and filters that maximize the utility of the design. Any suitable type of mask may be used, including medical masks, non-medical masks, gas masks, masks with or without filters, with multiple filters, those with special inlet/outlet sections, those including eye covering, without eye covering, cloth providing permeable or impermeable surfaces, etc. The benefits and advantages presented in the disclosure may apply to any suitable mask design.

As illustrated in FIG. 1, the mask apparatus may include an enclosed air channel 104 and air channel mouthpiece 106 (or ducted air channel) that provides a conduit for direct expiration (or exhalation) gas flow through the mask cavity. The example of FIG. 1 incorporates an air channel mouthpiece 106 that is adjustable in length and direction which holds position due to friction on the wall of the duct, created by an intersecting rolled convolution of the duct. The air channel mouthpiece 106 will better maintain its adjustment when left in the same position for an extended period of time due to elastic creep effect. The air channel mouthpiece 106 is made out of a soft silicone material with a contoured mouthpiece for a comfortable interface between the air channel and the user. The air channel mouthpiece 106 is designed with a venturi expander to provide efficient flow and reduce noise. The device is designed to minimize pressure drop from the inlet of the mouthpiece through the final expulsion of gas to the outside environment. This low-pressure differential allows one to take advantage of the low pressure created when the high velocity expiration from the user is directed through the air channel mouthpiece 106. Due to the low-pressure differential and the low pressure created from the high velocity expiration, the pressure in the mask cavity will typically be higher than the pressure in the high velocity expiration gas stream. If the user interface does not create an air tight seal to the air channel mouthpiece 106 this will cause the added benefit of entraining additional gas from the mask cavity into the lower pressure high velocity expiration gas stream. The example of FIG. 1 also incorporates air channel 104 which allows room for the convolution of the air channel mouthpiece 106 to move. The example of FIG. 1 also incorporates a one-way valve assembly consisting of vent shield 101 which shields and holds in place the valve diaphragm 102, which is a flexible diaphragm that creates the one-way restriction and seals against the valve diaphragm support connector seal ring. The valve diaphragm support connector seal ring 103, which supports the valve diaphragm 102 and also creates a connection or seal with a mask or support feature. The one-way valve constrains the gas flow through the air channel 104 and the air channel mouthpiece 106 to one direction. The one-way valve including vent shield 101, valve diaphragm 102 and valve diaphragm support connector seal ring 103 restricts exhaled gas and any gas located outside the mask cavity from reentering the mask cavity through the air channel 104 and the air channel mouthpiece 106. While the air channel 104 and the air channel mouthpiece 106 in the example of FIG. 1 have the properties indicated, the disclosure is not so limited. In some embodiments, the expiration tube 123, the inspiration tube 124, or air channel 104 and the air channel mouthpiece 106 may be long or short, may be fixed or adjustable in length and/or direction may be flexible or rigid, may have a flattened or contoured mouth piece to more easily allow the user to use continuously without discomfort. In some embodiments, the hose or air channel 104 and the air channel mouthpiece 106 may allow flow of gas in, out, or both to the wearer. Any of the components may be generally designed or custom-designed for a particular user to minimize leakage of air, reduce or eliminate cross contamination of inhalation and exhalation and isolate the effects of exhalation on inhalation and maximize the comfort of the device. The example in FIG. 1 is illustrated with a two-piece air channel. The air channel mouthpiece 106 attaches to the second piece air channel 104 through the use of the compression nut seal ring 105. The air channel 104, compression nut seal ring 105 and the air channel mouthpiece 106 are secured to face cover 107 through the use of a threaded pinch connection and seal rings between the compression nut seal ring 105 and the valve diaphragm support connector seal ring 103. In other embodiment, the air channel may be implemented using any number of elements from one and up. For example, the air channel may be one piece that both attaches to the face cover 107 and provides the air channel. In other embodiments where it may be suitable to provide tailored or additional features, the air channel may be provided in multiple pieces.

The mask may include a valve diaphragm support connector seal ring 103 for attaching the air channel to the face cover 107. In some embodiments, the valve diaphragm support connector seal ring 103 may be designed to minimize air leakage between the air channel 104 and the air channel mouthpiece 106 and the exterior of the face cover 107. Mechanisms to minimize air leakage may include use of various materials and processes. In some examples, the face of the valve diaphragm support connector seal ring 103 may be covered in adhesive to both mate to the face cover 107 (e.g., to a body component of an air filter). The adhesive may allow the valve diaphragm support connector seal ring 103 to completely seal out any air. In other examples, the valve diaphragm support connector seal ring 103 may mate to the face cover 107 at various locations and use various methods. In some examples where the air leakage is not a priority (e.g., but where comfort is a priority), the valve diaphragm support connector seal ring 103 may use hook and loops or barbs or a latching mechanism to securely attach to the face cover 107. While the disclosure provides the example of the valve diaphragm support connector seal ring 103, those skilled in the art will recognize that the valve diaphragm support connector seal ring 103 or coupling plate are merely illustrative examples. Any type of component or method may be used to attach the air channel 104 and the air channel mouthpiece 106 to the mask.

In some examples, the device (e.g., any combination of vent shield 101, valve diaphragm 102, valve diaphragm support connector seal ring 103, air channel 104, compression nut seal ring 105 and the air channel mouthpiece 106) may be a one-time use device. In other examples, the device may be a re-usable device so that the device can be removed and attached to face cover 107. In the embodiments including a re-usable design, the attachment mechanism may be selected from a suitable choice. In some embodiments a filter may be optional. When the filter is optional, the face cover 107 itself may provide the filtering. In some embodiments the air channel 104 and the air channel mouthpiece 106 and the valve diaphragm support connector seal ring 103 may be a monolithic component.

The various components may be mated together using any of a variety of methods. In some examples where speed of assembly is important, the pieces may merely snap into each other (e.g., grooves or friction may be used to hold the components together, in the case of friction may be design with increasing diameter to increase linear friction). In other examples, such as health settings where air leakage is important, the components may include various air-proof or moisture-proof coatings. When such coatings are applied, the components, in some cases, may be more suitable for one-time usage type devices. In some examples, screw-type threaded mating surfaces may be used. In examples where existing mask designs are applied or retrofitted, adhesives and other bonding agents may be suitable for the device. Any combination of these mating mechanisms and methods may be applied for the various components.

The mask may be assembled in any operative order. For example, the air channels 104, 106 and compression nut seal ring 105 may be mated first, with the assembly then mated to the face cover 107 through the use of the valve diaphragm support connector seal ring 103.

The embodiments may be used for inhaled (upstream) or exhaled (downstream) or both. For example, the user may breathe through the air channels 104, 106 (downstream) and breathe out the rest of the mask. For example, the user may breathe out through the air channel 104 and the air channel mouthpiece 106 (downstream) and breathe in through the rest of the face cover 107. For example, the user may breathe in through the air channel 104 and the air channel mouthpiece 106 (upstream) and breathe out through the air channel 104 and the air channel mouthpiece 106 (downstream). In some examples, the user may alternate upstream and downstream usage of the air channel 104 and the air channel mouthpiece 106 during breathing. The user may generally breathe in any manner based on user preference or mask design.

In the cases where the user breathes partially through the air channel 104 and the air channel mouthpiece 106 and through the rest of the face cover 107, the user may prefer larger diameter air channels so that they may easily breathe using the air channel 104 and the air channel mouthpiece 106 or breathe without using the air channel 104 and the air channel mouthpiece 106. The design of the air channel size, shape, length, etc. may be dictated by user preference.

Figure 2:
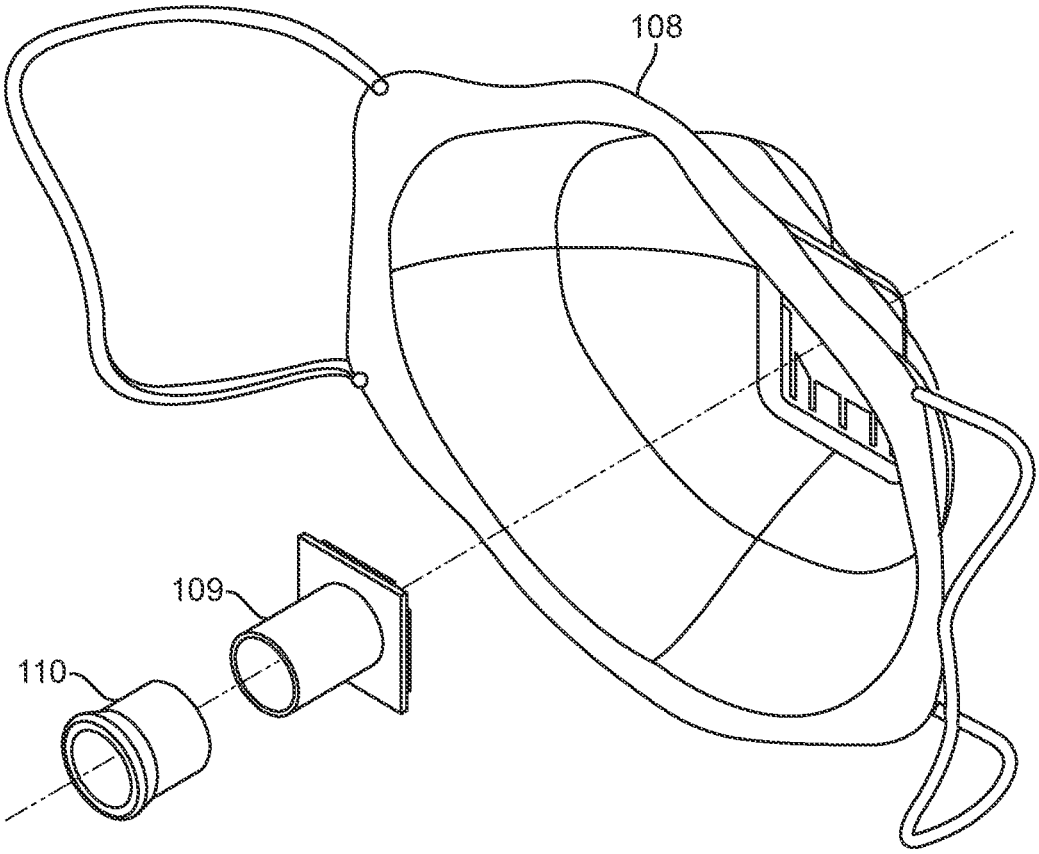
FIG. 2 is an exploded view of an example mask apparatus, illustrating a retrofit kit option for use with upstream filtration and no downstream filtration, according to an embodiment of the disclosure

FIG. 2 is an exploded view of another example mask apparatus, according to an embodiment of the disclosure. The mask with exhalation valve (or cover, shield, etc.) 108 may be a similar embodiment to FIG. 1. The mask with exhalation valve 108 shows the coupling plate 109 and replaceable mouthpiece 110 mated to the mask with exhalation valve 108. In this example, the coupling plate 109 may use an adhesive. Those skilled in the art will recognize that any of a variety of methods and mechanisms may be used to mate the components.

The mask may include a mask with exhalation valve 108 that provides physical coverage for isolating the wearer's face, nose, and mouth from the outside environment. The mask with exhalation valve 108 may be a one-size-fits-all component that is suitable for most or all people. In some embodiments, the mask with exhalation valve 108 may be specially design for each wearer. In other embodiments, the mask with exhalation valve 108 may take various forms and shapes.

The embodiments may be used for retrofitting existing designs or masks purchased off-the-shelf which incorporate a one-way exhalation valve. Other embodiments may be used with specially design covering and filters that maximize the utility of the design.

The example of FIG. 2, however, includes an inner coupling plate 109, that may also be part of an air channel. The pieces may be mated with additional mechanisms in addition to those discussed above with respect to FIG. 1. For example, the coupling plate 109 may be designed as complementary components to the mask with exhalation valve 108 e.g., screwed together. The coupling plate 109 may also use the same mechanisms as FIG. 1, such as adhesives, bonding agents, etc., or snap together using friction. The coupling plate 109 may be airtight connection with the mask with exhalation valve 108.

The method to assemble the device may be similar to that described above with respect to FIG. 1. The similar steps are omitted for brevity. In the embodiments with a screw type connection, the method may be adjusted according to the screw design.

Figure 3:
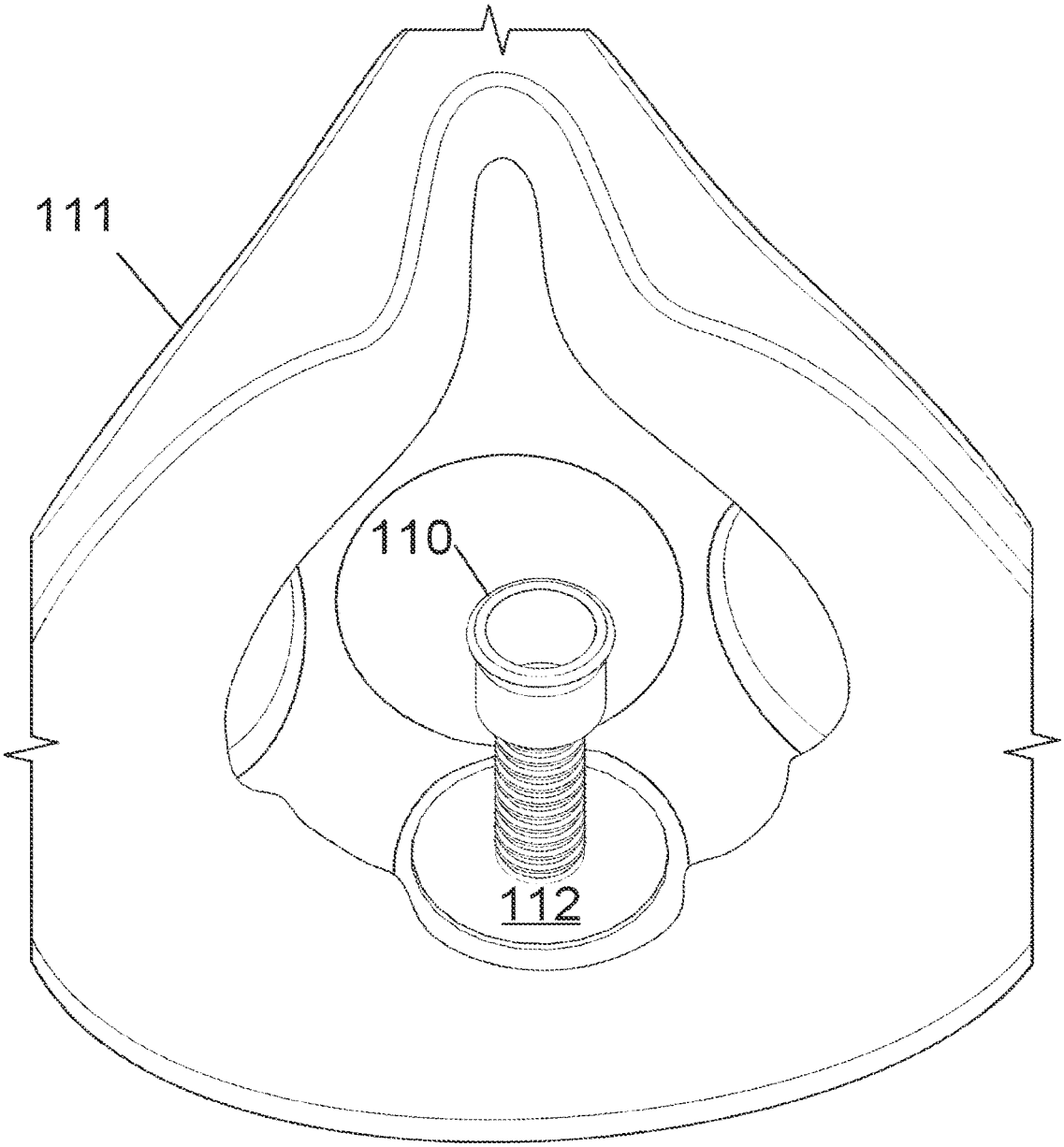
FIG. 3 is an interior view of an example mask apparatus utilizing a reusable respirator with replaceable filter elements, for use with upstream filtration and no downstream filtration, according to an embodiment of the disclosure (Method 1).

FIG. 3 is an interior view of another example mask apparatus, according to an embodiment of the disclosure. The mask may be a similar embodiment to FIG. 2. Descriptions of the shared components from FIG. 2 are omitted for brevity. The mask shows an embodiment using a respirator with a rubber or flexible snug cover 111 and may include replaceable filter elements. The replaceable mouthpiece 110 and the coupling plate for flexible snug cover 112 in this example may have a large diameter to provide more air and freer breathing. In some cases, the filter (not visible) may be suitably designed to match the air channel design (e.g., larger filter for larger air channel).

Figure 4:
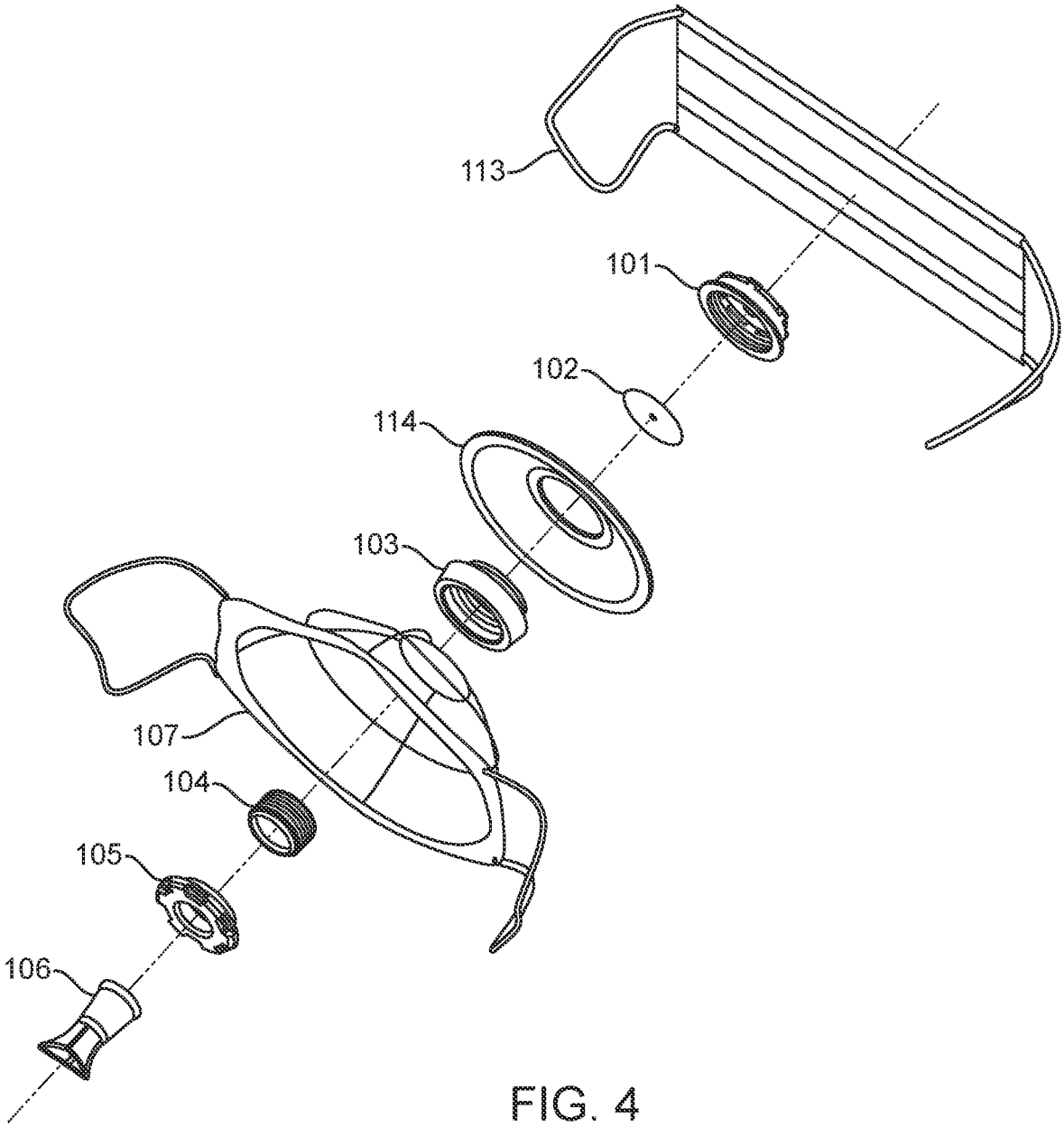
FIG. 4 is another exploded view of an example mask apparatus illustrating upstream filtration and downstream filtration utilizing a filter element for the downstream not sealed to the heat shield ducting, according to an embodiment of the disclosure

FIG. 4 is an exploded view of another example mask apparatus, according to an embodiment of the disclosure. The mask may be a similar embodiment to FIG. 1 with the addition of filtration part (or filtration element) 113 for source control and a heat shield duct 114 to shield the user from the heat generated from the exhaled respiration and divert and direct the exhaled respiration gas away from the user. Descriptions of the shared components from FIG. 1 are omitted for brevity. In this example the filtration part 113 can consist of a reusable or disposable mask filter medium which can be fitted over the heat shield duct for effective source control. The one-way valve including vent shield 101, valve diaphragm 102, valve diaphragm support connector seal ring 103 increases the efficiency of reducing cross contamination between inhalation and exhalation gas but a one-way valve is not always required to be effective in this configuration.

Figure 5:
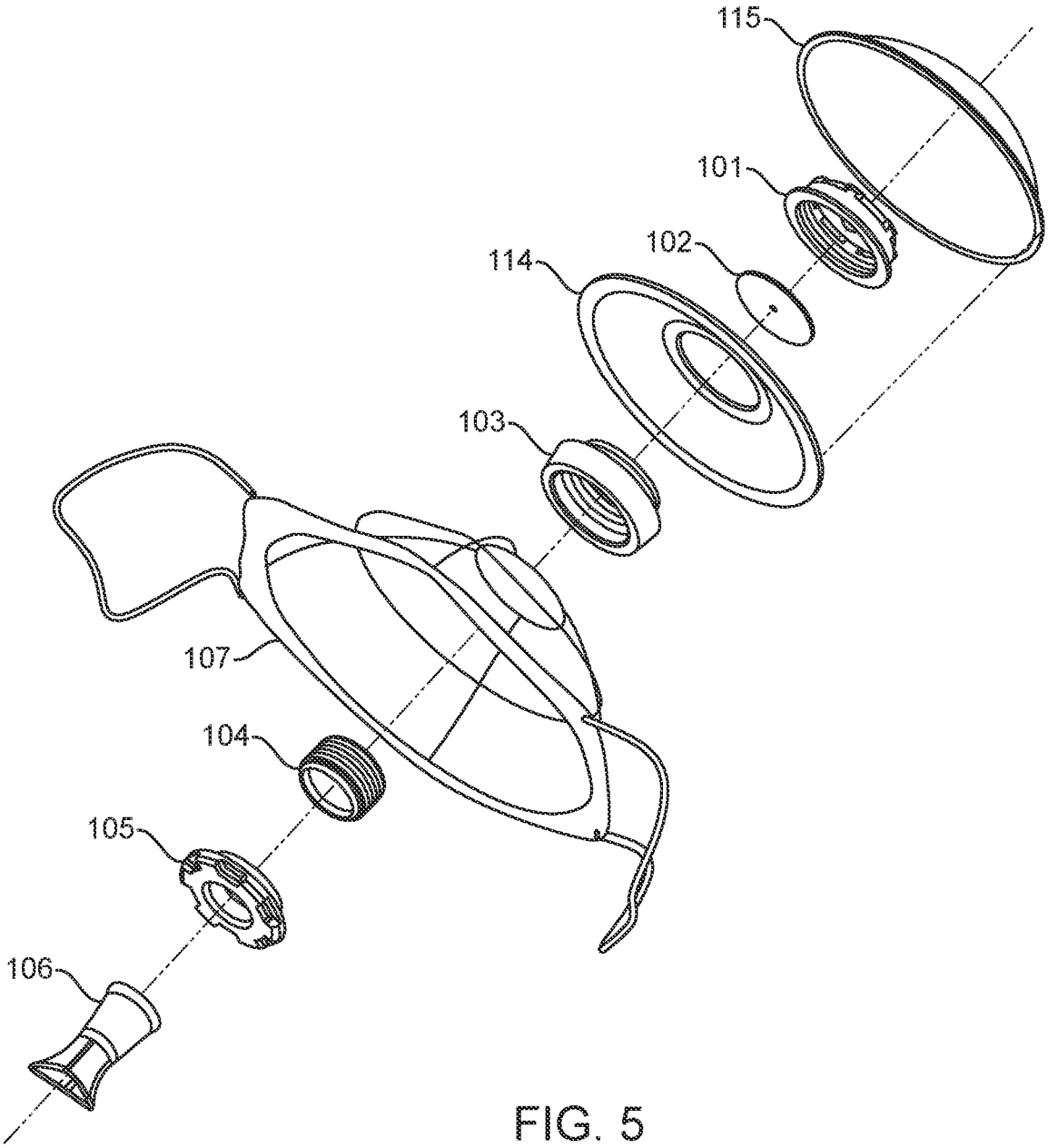
FIG. 5 is another exploded view of an example mask apparatus illustrating upstream filtration and downstream filtration, utilizing a filter element for the downstream filtration which is sealed to the heat shield ducting, according to an embodiment of the disclosure

FIG. 5 is an exploded view of another example mask apparatus, according to an embodiment of the disclosure. The mask may be a similar embodiment to FIG. 4 with the addition of an exhalation filter 115 that is sealed to the perimeter of the heat shield duct 114. This increases the efficiency of source control and better directs the exhalation away from the users face. Descriptions of the shared components from FIG. 4 are omitted for brevity. The one-way valve including vent shield 101, valve diaphragm 102, valve diaphragm support connector seal ring 103 increases the efficiency of reducing cross contamination between inhalation and exhalation gas but a one-way valve is not always required to be effective in this configuration.

Figure 6:
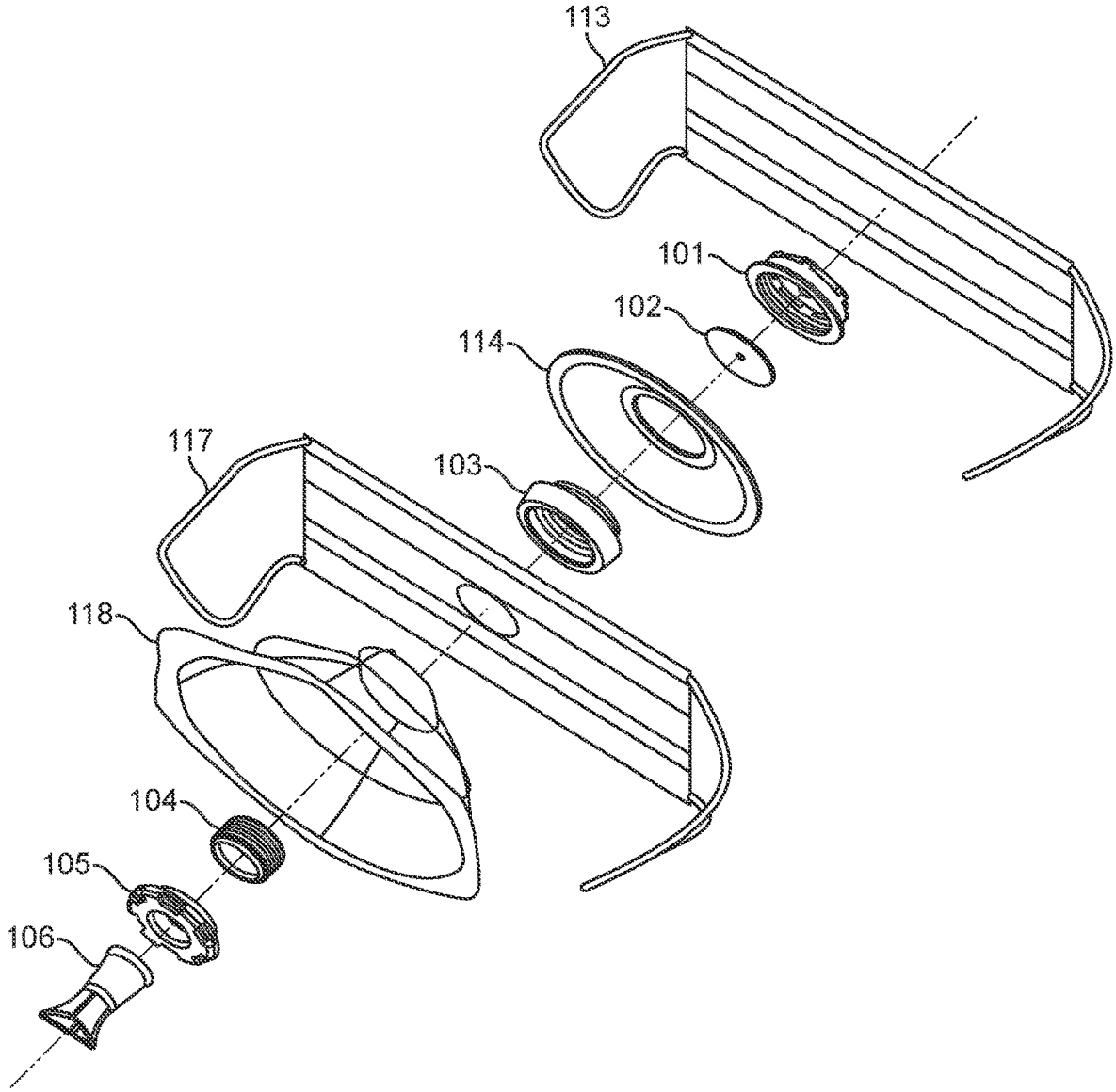
FIG. 6 is another exploded view of an example mask apparatus illustrating upstream filtration and downstream filtration utilizing an upstream filter element which requires a duct support frame and a filter element for the downstream not sealed to the heat shield ducting, according to an embodiment of the disclosure.

FIG. 6 is an exploded view of another example mask apparatus, according to an embodiment of the disclosure. The mask may be a similar embodiment to FIG. 5 except mask/cover with air channel hole 117 and duct support frame 118 replaces mask/facecover 107. Duct support frame 118 allows the user to utilize non cup type mask/cover with air channel hole 117 for the inhalation filter medium. The one-way valve including vent shield 101, valve diaphragm 102, valve diaphragm support connector seal ring 103 increases the efficiency of reducing cross contamination between inhalation and exhalation gas but a one-way valve is not always required to be effective in this configuration.

Figure 7:
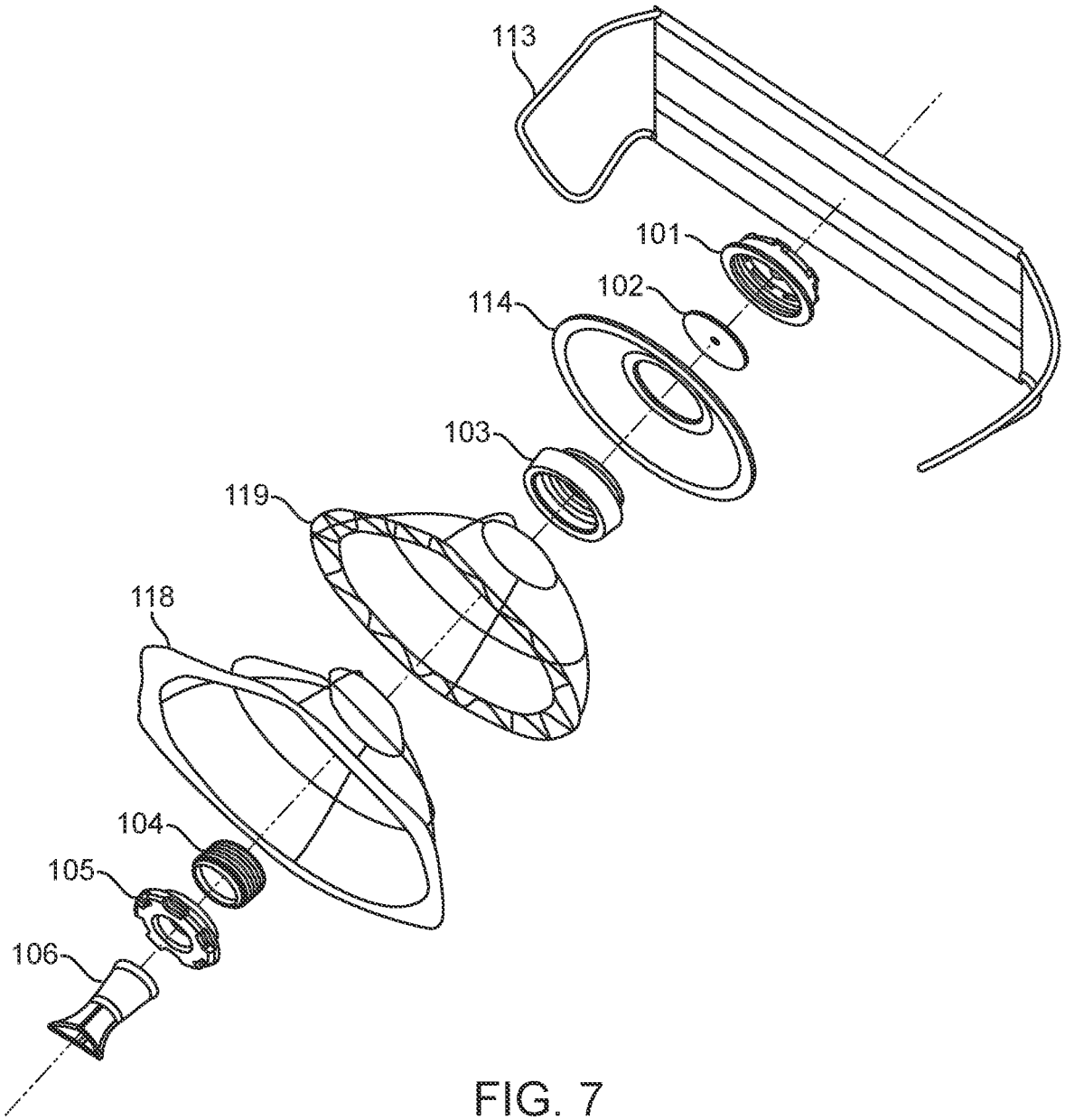
FIG. 7 is another exploded view of an example mask apparatus illustrating upstream filtration and downstream filtration utilizing an upstream filter element which attaches to and is supported by the duct support frame and a filter element for the downstream not sealed to the heat shield ducting, according to an embodiment of the disclosure.

FIG. 7 is an exploded view of another example mask apparatus, according to an embodiment of the disclosure. The mask may be a similar embodiment to FIG. 6 except mask/cover with air channel hole 117 is replaced by duct support frame filter cover 119. Duct support frame filter cover 119 is a reusable or disposable inhalation filter element that is supported by and or attached to duct support frame 118. The one-way valve consisting of vent shield 101, valve diaphragm 102, valve diaphragm support connector seal ring 103 increases the efficiency of reducing cross contamination between inhalation and exhalation gas but a one-way valve is not always required to be effective in this configuration.

Figure 8:
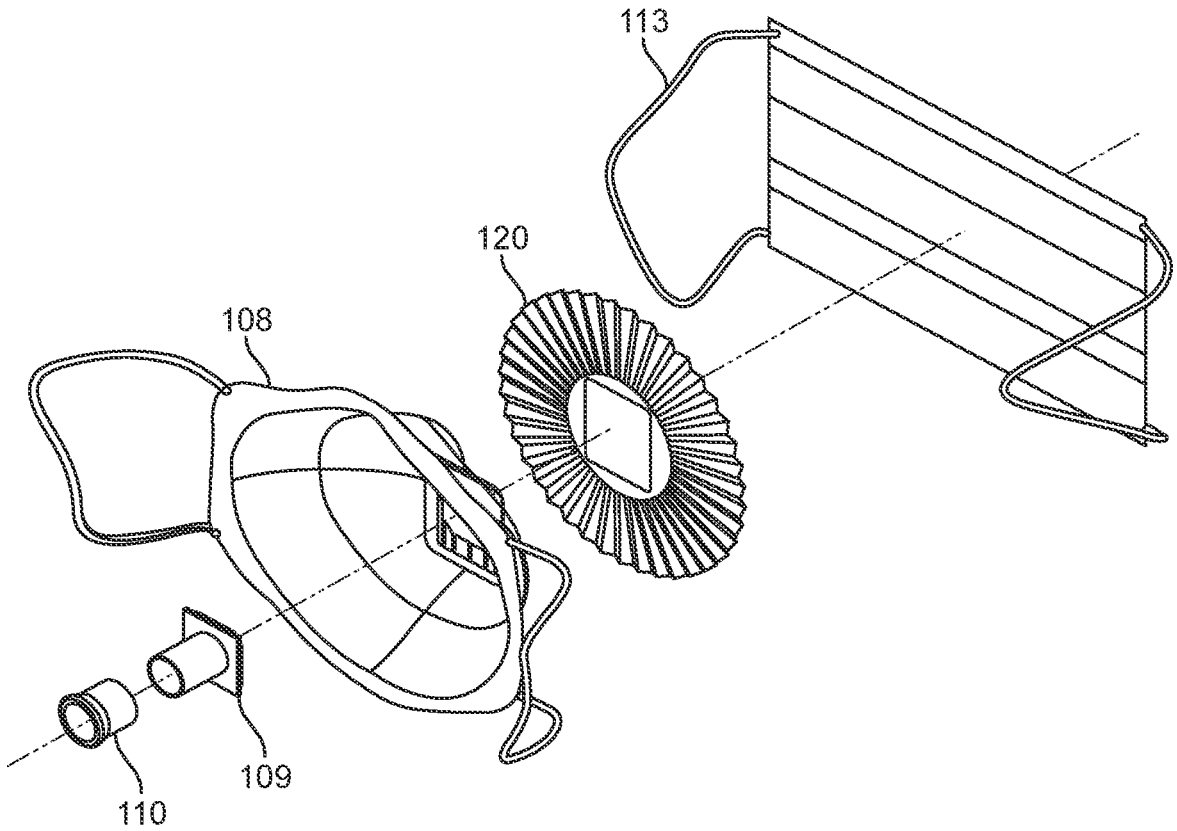
FIG. 8 is an exploded view of an example mask apparatus, illustrating a retrofit kit option for use with upstream filtration and downstream filtration, utilizing a filter element for the downstream not sealed to the heat shield ducting, according to an embodiment of the disclosure.

FIG. 8 is an exploded view of another example mask apparatus, according to an embodiment of the disclosure. The mask may be a similar embodiment to FIG. 2 with the addition of filtration part 113 for source control and a retrofit heat shield duct 120 to shield the user from the heat generated from the exhaled respiration and divert and direct the exhaled respiration gas away from the user. Descriptions of the shared components from FIG. 2 are omitted for brevity. In this example the filtration part 113 can consist of a reusable or disposable mask filter medium which can be fitted over the heat shield duct for effective source control. The one-way valve consisting of vent shield 101, valve diaphragm 102, valve diaphragm support connector seal ring 103 increases the efficiency of reducing cross contamination between inhalation and exhalation gas but a one-way valve is not always required to be effective in this configuration.

Figure 9:
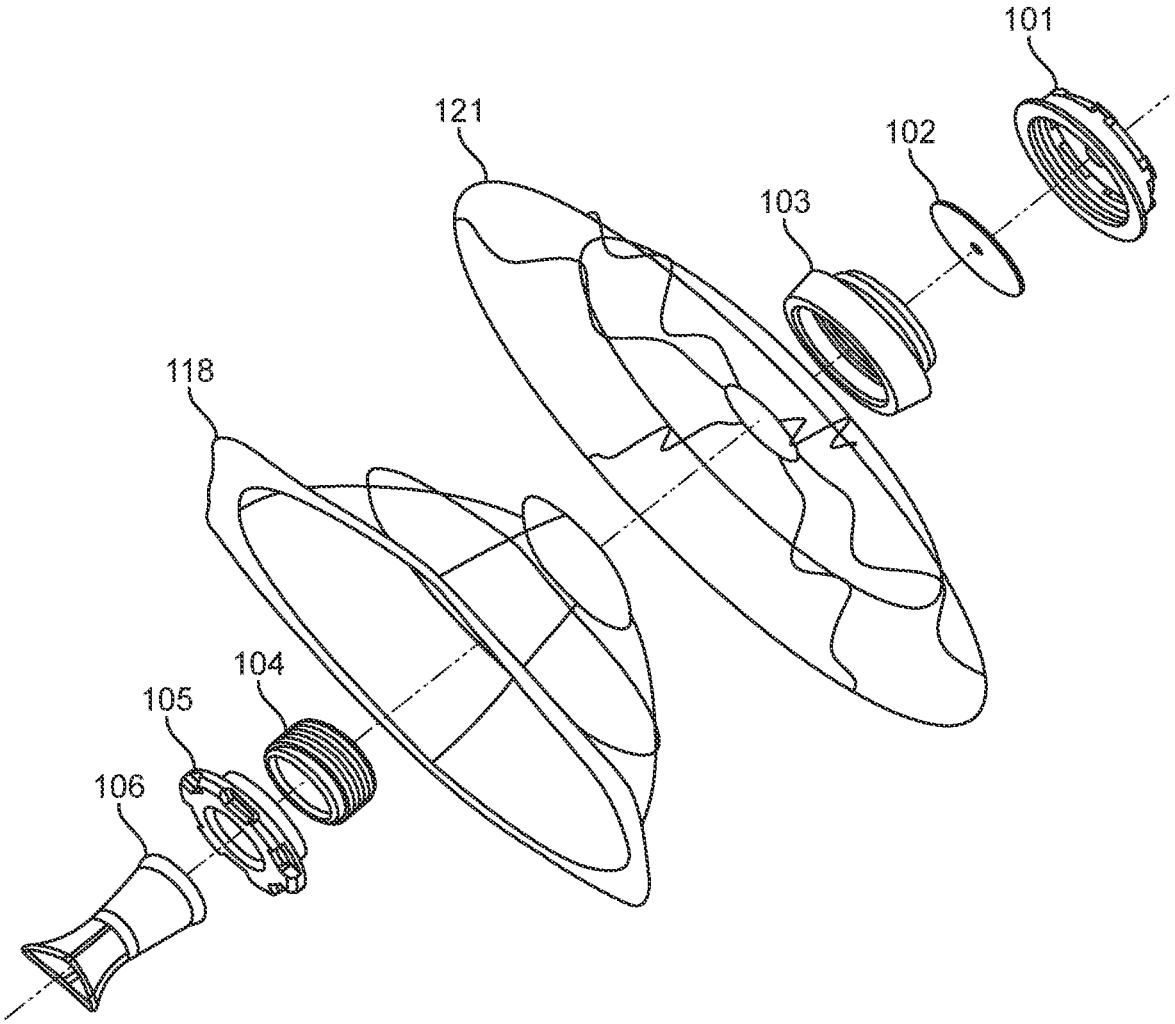
FIG. 9 is another exploded view of an example mask apparatus illustrating the use of a ducted breathing apparatus incorporating a duct support frame to support the ducted air channel element which provides a direct air flow from a user's mouth within the mask/barrier/shield to an environment outside the mask/barrier/shield, according to an embodiment of the disclosure.

FIG. 9 is an exploded view of another example mask apparatus, according to an embodiment of the disclosure. The mask may be a similar embodiment to FIG. 6 except mask/cover with air channel hole 117 is replaced by shield 121, which has hole to accept ducting and filtration part 113 and heat shield duct 114 are removed. Shield 121 can be a barrier, shield, garment (such as a ski mask), costume face covering or safety gear but not limited to only these items. Shield 121 may or may not be part of an enclosed environment. This configuration is typically used for but not limited to use in severe environmental conditions such as high wind, cold or heat. Shield 121 can be made of permeable or impermeable material and must incorporate a passageway to mate with the valve diaphragm support connector seal ring 103, air channel 104 and compression nut seal ring 105. Duct support frame 118 supports and holds in position the ducted air channel elements of the valve diaphragm support connector seal ring 103, air channel 104, compression nut seal ring 105, and the air channel mouthpiece 106. The one-way valve including vent shield 101, valve diaphragm 102, valve diaphragm support connector seal ring 103 increases the efficiency of reducing cross contamination between inhalation and exhalation gas and reduces the infiltration of gas from the outside environment. A one-way valve does increase the efficiency but is not always required to be effective in this configuration. In some applications a duct support frame 118 is not always required.

Figure 10:
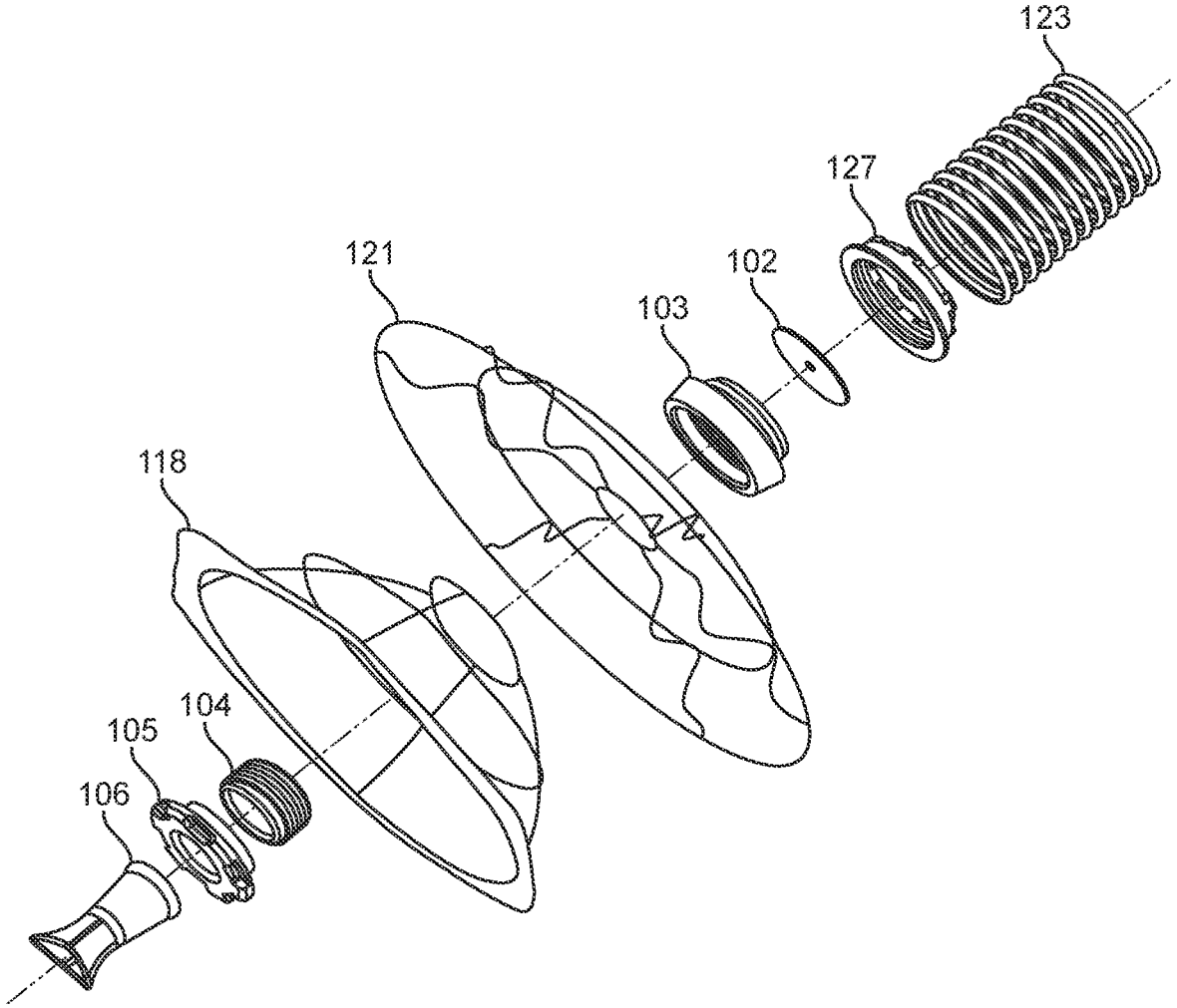
FIG. 10 is another exploded view of an example mask apparatus illustrating the use of a ducted breathing apparatus incorporating a duct support frame to support the ducted air channel element which provides a direct air flow from a user's mouth within the mask/barrier/shield to remote environment some distance outside the mask/barrier/shield, according to an embodiment of the disclosure.

FIG. 10 is an exploded view of another example mask apparatus, according to an embodiment of the disclosure. The mask may be a similar embodiment to FIG. 9 with the addition of an expiration tube 123 and by replacing vent shield 101 with vent shield tube connector 127. Vent shield tube connector 127 allows for the connection of a respiration tube to the apparatus. The expiration tube 123 allows the user to direct the exhaled gas to a remote environment. In some applications a duct support frame 118 is not always required.

Figure 11:
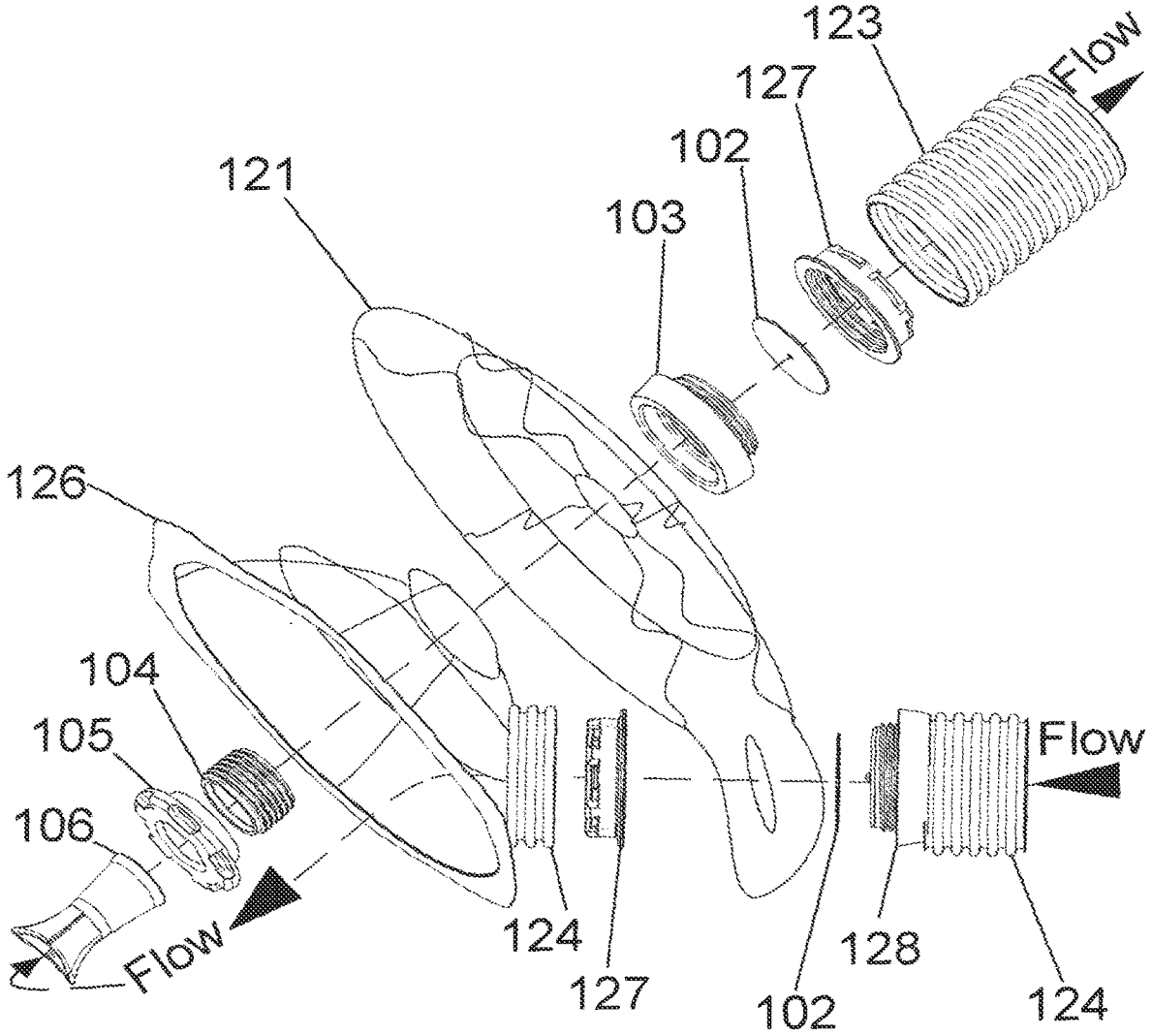
FIG. 11 is another exploded view of an example mask apparatus illustrating the use of a ducted breathing apparatus incorporating a duct support frame to support a ducted inspiration channel for supply from a remote environment some distance outside the mask/barrier/shield and also the ducted air channel element which provides a direct air flow from a user's mouth within the mask/barrier/shield to remote environment some distance outside the mask, according to an embodiment of the disclosure.

FIG. 11 is an exploded view of another example mask apparatus, according to an embodiment of the disclosure. The mask may be a similar embodiment to FIG. 10 with the addition of an inspiration tube 124, valve diaphragm support connector seal ring tube connector 128 (which adds a respiration tube connector to the diaphragm support), and valve diaphragm 102 for the inhalation one way valve along with the vent shield tube connector 127 to connect the inhalation tube to the with an impermeable duct support frame 126 that creates a seal to the users face and has an additional feature which allows for the connection of an inhalation duct and also a valve diaphragm 102. The inspiration tube 124 allows the user source gas for inspiration from a remote environment.

Figure 12:
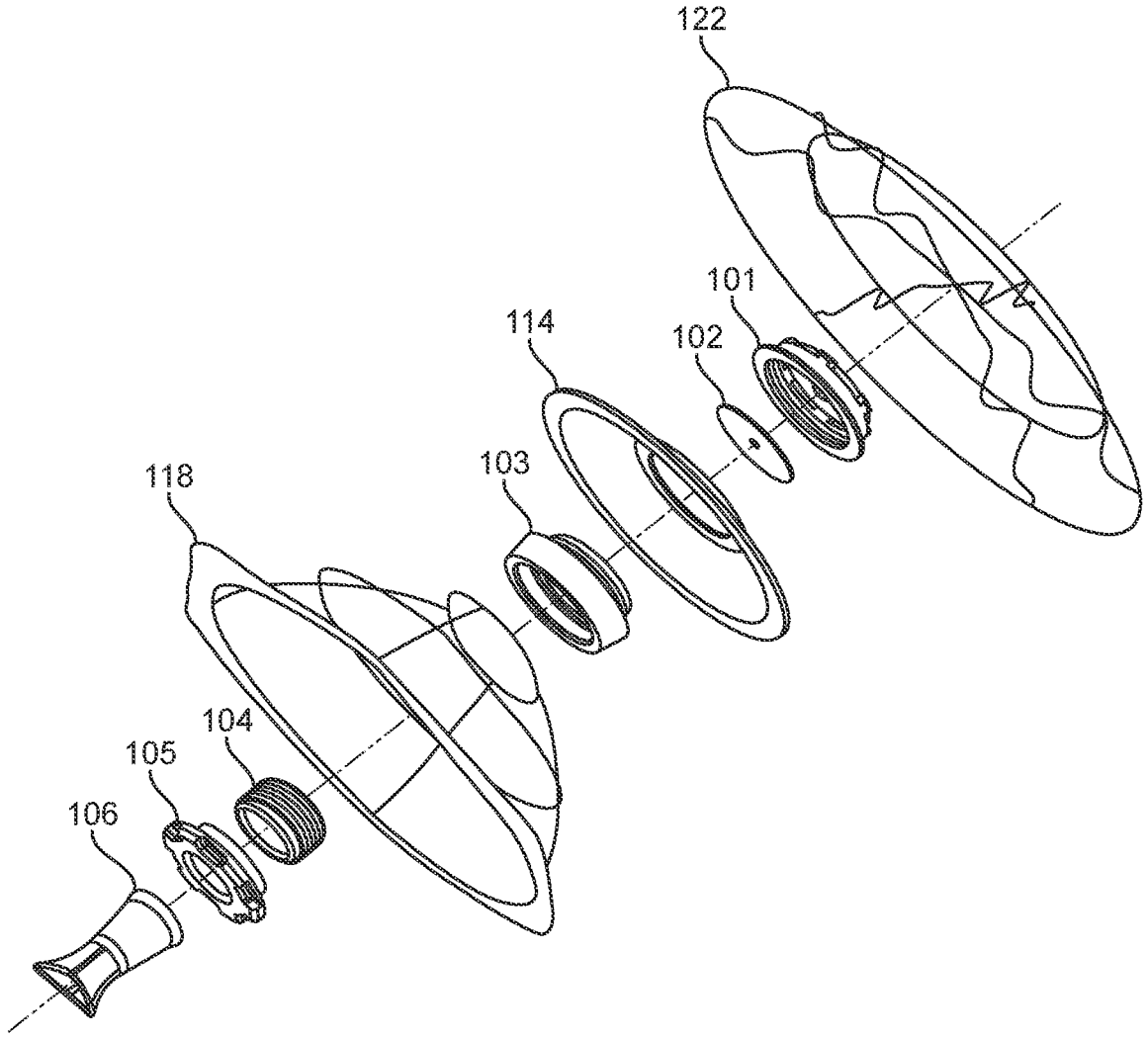
FIG. 12 is another exploded view of an example mask apparatus illustrating the use of a ducted breathing apparatus incorporating a duct support frame to support the ducted air channel element and heat shield ducting which provides a direct air flow from a user's mouth within the mask/barrier/shield to an environment outside the mask/barrier/shield, according to an embodiment of the disclosure.

FIG. 12 is an exploded view of another example mask apparatus, according to an embodiment of the disclosure. The mask may be a similar embodiment to FIG. 9 with the removal of shield 121 and the addition of a heat shield duct 114 and barrier 122. Barrier 122 is similar to shield 121 but does not incorporate a passageway to mate with the valve diaphragm support connector seal ring 103, air channel 104 and compression nut seal ring 105 and typically is made of permeable material. The heat shield duct 114 is used to shield the user from the heat, humidity and other undesirable constituents generated from the exhaled respiration and directs the exhalation away from the user through a permeable barrier 122. A one-way valve does increase the efficiency but is not always required to be effective in this configuration. In some applications a duct support frame 118 is not always required.

Figure 13:
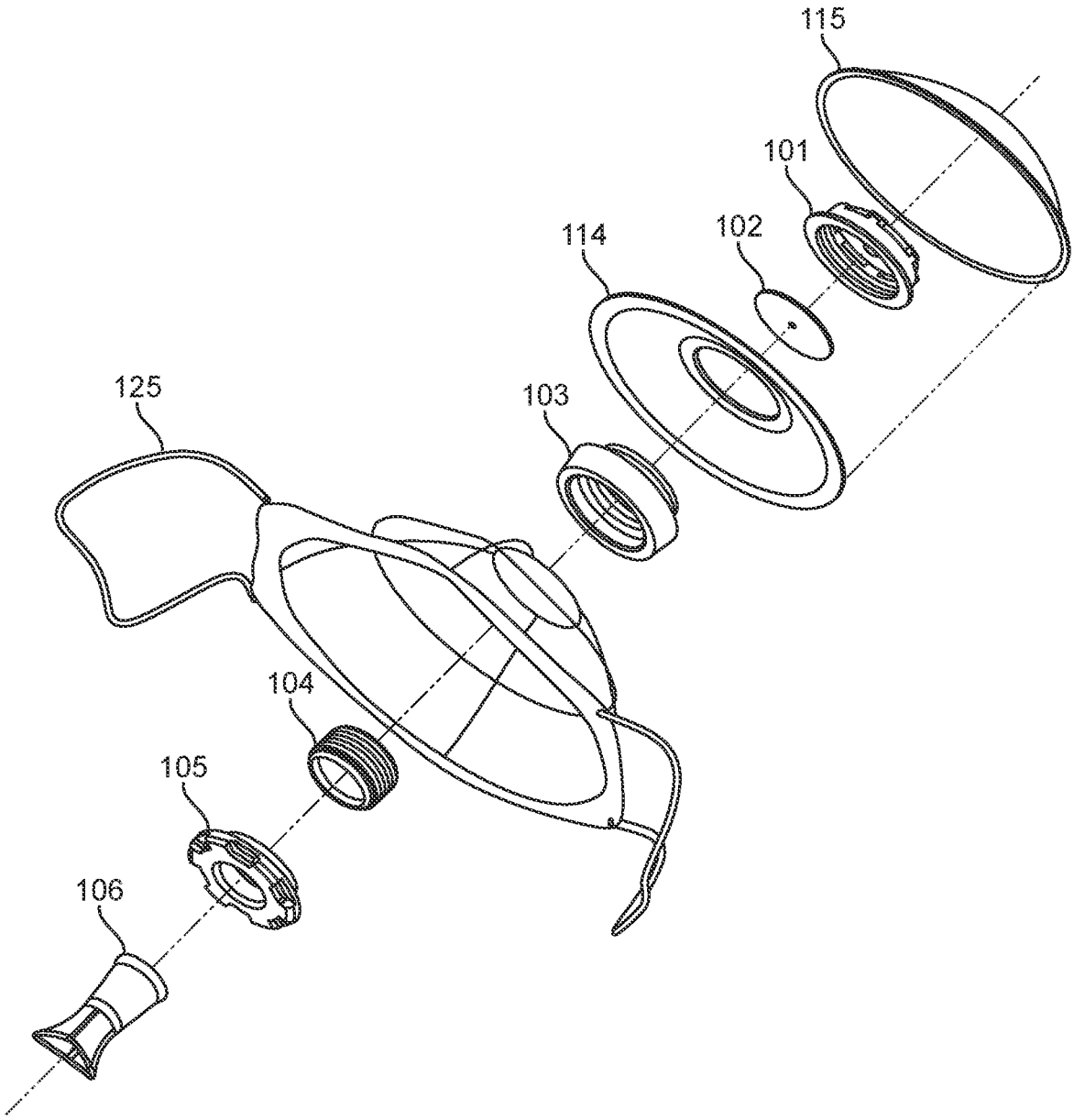
FIG. 13 is an exploded view of an example mask apparatus, illustrating no upstream filtration but has downstream filtration, according to an embodiment of the disclosure.

FIG. 13 is an exploded view of another example mask apparatus, according to an embodiment of the disclosure. The mask may be a similar embodiment to FIG. 5 by replacing face cover 107 with the permeable duct support frame 125. This configuration allows for source control when there is no need to condition the air in the breathing environment. A one-way valve does increase the efficiency but is not always required to be effective in this configuration.

Figure 14:
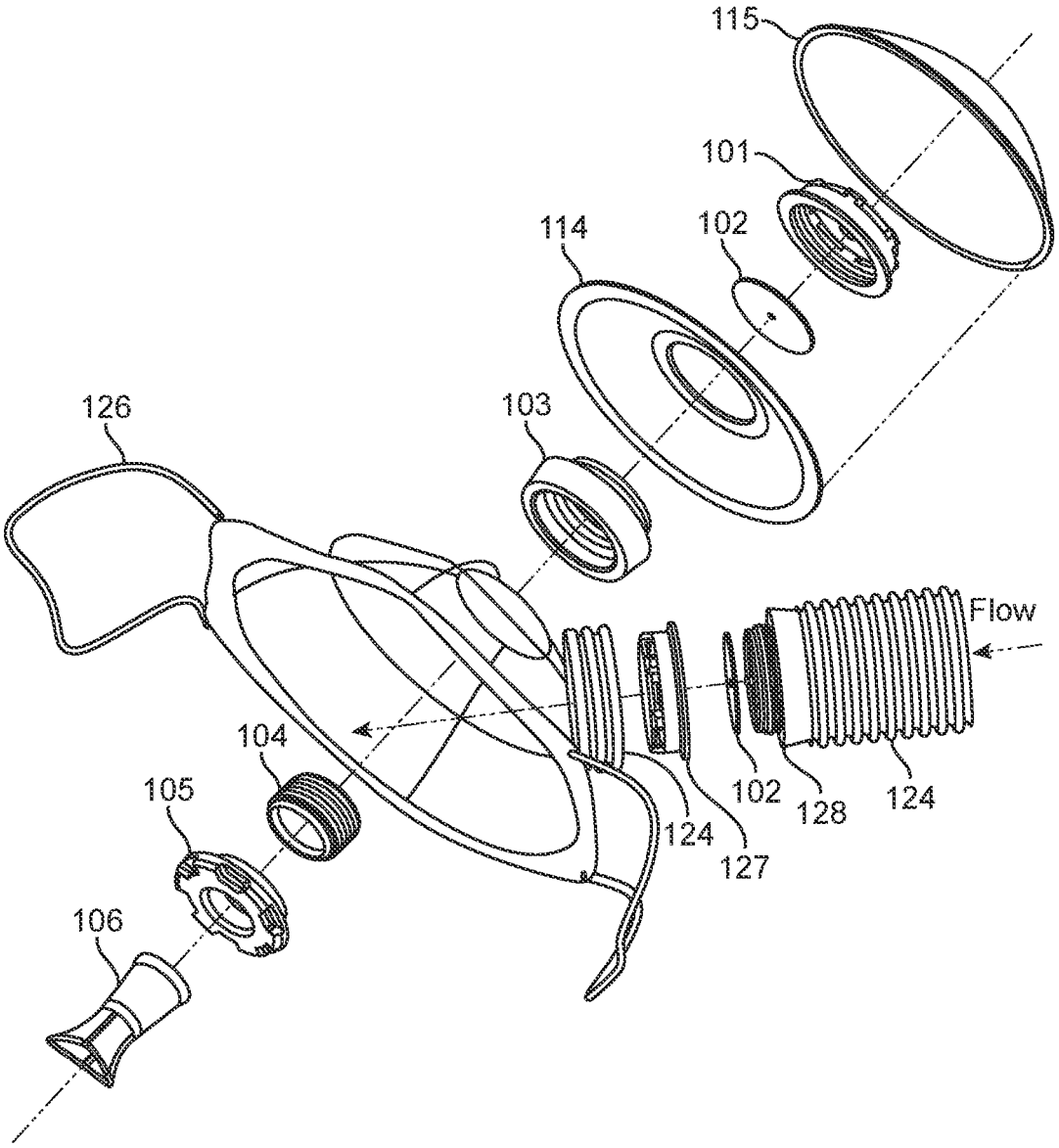
FIG. 14 is another exploded view of an example mask apparatus, illustrating no upstream filtration but has downstream filtration, with a ducted air channel element which provides a direct air flow from a user's mouth within the mask/barrier/shield to a remote environment outside the mask.

FIG. 14 is an exploded view of another example mask apparatus, according to an embodiment of the disclosure. The mask may be a similar embodiment to FIG. 13 by replacing the permeable duct support frame 125 with an impermeable duct support frame 126 that creates a seal to the users face and has an additional feature which allows for the connection of an inhalation duct. The valve diaphragm 102, inspiration tube 124, vent shield tube connector 127, and valve diaphragm support connector seal ring tube connector 128 are added to connect the inspiration tube with the one way valve. The impermeable duct support frame 126 is designed for the attachment of the valve diaphragm support connector seal ring 103, air channel 104, compression nut seal ring 105 and the air channel mouthpiece 106 and inspiration tube 124. Inspiration is supplied through the inspiration tube 124. This configuration allows for a more consistent dosing of medications since the supply is not diluted with residual exhalation gas trapped in the mask cavity. This configuration also allows for source control when the user requires respiration from a remote source for the inhalation of medications, use of a nebulizer or requires specialized conditioning of the user's breathing environment. Source control is provided to prevent contamination of the environment near the user if the exhalation from the user may cause a toxic environment to others.

In some examples, a respiration flow-directed breathing apparatus used in conjunction with one or more aspects of the disclosure may be used with or without filtration utilizing any of or all following examples: respirator, respiration device, industrial safety equipment, filtering face-piece respirator, full or half face respirator, mask, shield, helmet, fabric covering, inspiration supply tube, expulsion tube, example but not limited film, entertainment, art, characters in costumes at theme parks, movie sets, mascot but not limited to where user requires a more effective comfort and increased overall performance of breathing device, example but not limited to headdress, tunic, turbans, burka, head scarf, hijab, face veil, keffiyeh, hattah, other devices utilizing a wide range materials, where expiration can be directed from a user's mouth; nose; or the combination of mouth and nose, dispersed to the outside environment to reduce or eliminate cross contamination between inhaled respiration and exhaled respiration. This new apparatus may include any combination or lack of the following but not limited to: mouthpiece, ducting, shielding, baffling, filtering, diffuser, gasket, flange, adhesive, hook & loop, screw, nut, bolt, fastener, one way valve, vent, extended vent, wide range of connection methods and materials.

The apparatus improves one or more of the following: safety, effectiveness, efficiency, comfort, reduction of negative physiological effects, reduction of nuisance internal and external condensation.

The apparatus can be used in the following areas but not limited to:

1. The apparatus improves equipment within the health industry, professional, commercial, government and consumer purposes.

2. The apparatus improves equipment within the sporting/health professional, health industry, professional, commercial, government and consumer for purposes in high, low, standard altitudes.

3. The apparatus improves equipment within the aquatic/health professional, industry, professional, commercial, government and consumer for purposes in water.

4. The apparatus improves equipment within the winter gear professional, industry, professional, commercial, government and consumer for purposes in cold temperatures.

5. The apparatus improves equipment within the healthcare professional, industry, professional, commercial, government and consumer for purposes in therapies or treatments to ease or fight against health-related concern.

6. The apparatus improves equipment within the life-saving professional, industry, professional, commercial, government and consumer for purposes in uses to help with life-saving equipment and processes.

7. For the use with fungus isolation, germ isolation, medial purposes, pollen isolation purposes, virus isolation purposes, protection against viral infection, surgical masks and procedure masks, therapeutic facial masks, universal and portable disposable face mask, respirator mask for medical and non-medical purposes, reusable sanitary masks for protection against viral infection, fungus isolation, germ isolation, medical purposes, pollen isolation purposes, virus isolation purposes, protection against viral infection, but not limited to the above descriptions.

The Benefits of the Respiration Flow Apparatus:

1. The apparatus directs the fog or moisture created by exhalation away from external devices reducing nuisance condensation which would otherwise obscure vision on but not limited to: glasses, goggles, face shield, helmet, full-face respirator. Elimination of condensation greatly improves visibility and optical clarity on glasses, googles, and other eye equipment that would be affixed to the apparatus or not affixed but worn in place separately on user.

2. The apparatus can be used with supplied air technology.

3. This device can be used to eliminate the presence of residual used air in the mask cavity. This device allows for a compact designed respirator through the use of ducting and shielding to reduce the negative effects and cross contamination that expiration has on inspiration gas quality. This device can maintain a constant supply of fresh air to the user without the use of internally or externally powered air supply devices.

4. Buildup of facial heat and humidity in the mask cavity has been shown to significantly decrease comfort. Face mask associated facial heat and humidity may cause a variety of effects, including local dermal effects, increased temperature of breathing air, elevated core temperature and psychophysiological responses. The apparatus addresses these issues by effectively channeling the heat and humidity from exhalation out of the mask cavity and away from the user through the use of ducting and shielding to increase physical comfort.

5. The apparatus extends the useful life of filter mediums. High heat and humidity can affect the structural integrity of a filtering facepiece respirator. Many filtering facepiece respirators employ an electrostatic mechanism to attract and intercept foreign particles. Filtering facepiece respirator of this type undergo significant electrostatic degradation when open to the surroundings and is exacerbated by the warm humid environment created by respiration during use. When using this apparatus in conjunction with a filtering facepiece respirator, the amount of heat and humidity the filter medium is subjected to, internally in the mask cavity and externally is greatly diminished therefore maintaining a higher level of effectiveness and structural integrity when the respirator must be utilized for extended periods of time.

6. The apparatus reduces cross contamination between inhaled and exhaled air. With proper use of the apparatus, a significant reduction in re-breathed infectious virus aerosols or small airborne particles produced during coughing, speaking, sneezing, and breathing is realized. The reduction of cross contamination effectively reduces the viral load of a virus infected individual, by reducing the re-inhalation of contaminated exhaled gas and droplets. Exhaled gas from the virus infected individual is passed through the mask cavity and therefore does not remain a component of the mask cavity and is not available for re-inhalation. Direct expulsion of expiration through the mask cavity significantly reduces the buildup of undesirable constituents found in expiration. Bad breath smell in the mask cavity is significantly reduced since odors from the lungs or sinuses which contribute to bad breath smell are passed directly through the mask cavity and therefore does not remain a component of the mask cavity and is not available for re-inhalation. Contaminants from expiration such as carbon dioxide found in expiration are also passed directly through the mask cavity and therefore does not remain a component of the mask cavity and are not available for re-inhalation.

7. Due to the one-way nature of the inhalation and exhalation flow pathway, inhalation and exhalation environments can be located at a significant distance from the user without the need for pressurized air supplies.

8. Reusable kit will reduce waste. This reduces waste as example in the health field-one disposable respirator can be worn for a longer period of time due to the dryer nature of the inside of the cavity not breaking down the effectiveness of the fibers for the protection of the user.

9. Apparatus can be designed to be a retro-fit conversion kit for many or all current face coverings that are manufactured in the past, currently, or in the future thus saving costs and waste allowing end user to utilize available face covering of choice or necessity to utilize the advantages of a respiration flow apparatus by attaching to its current unit. Apparatus can be a add on feature of a variety of components that is secured onto existing product that completed a manufactured process or can be added into a complete unit during production for distribution as a final product.

Apparatus may be manufactured or designed utilizing a method that ensures the ability easily dismantle and enable the ability for the user to effectively recycle the parts and improving the impact to the environment. Apparatus may be manufactured or designed utilizing a method that allows the user to easily assemble and dismantle to efficiently sanitize and reuse for purposes of limiting the increased waste and cost associated with one-time use products. The apparatus may be manufactured or designed utilizing a method that can be attached to disposable face protection and then removed, cleaned, sanitized using standards of method of care, sanitized using standards within the medical community, sanitized using standards of care utilizing autoclave procedures and ensuring the long-term strength and effectiveness of the equipment to be in a material that will ensure this possibility.

10. In the absence of a seal, aerosols spread throughout the facemask and can leak out and spread infectious agents. With the use of this apparatus (such as configuration indicated in FIG. 5) infectious aerosols can be directly rerouted to a sealed filter medium and will not leak out unlike surgical mask, cloth mask or other personal face mask which do not create a seal.

11. Respirators equipped with one-way breathing valves can expose the user to environmental contaminants when the valve malfunctions or does not create an air tight seal. This apparatus maintains all the advantages of a one-way valve without the risk of exposure due to malfunctioning valve. When configured as indicated in the various embodiments such as FIG. 5, any gas that may flow back through the one-way valve is either residual air from expiration or filtered.

12. A ducted breathing apparatus that minimizes cross contamination between inhalation and exhalation respiration and minimizes the effects such as heat cold radiation conduction convection radiation from one to the other.

Some example structures, assemblies, and methods for using the various embodiments are described below.

Various embodiments may include application of the techniques and designs of the disclosure to commercial, industrial, medical, governmental respirators such as full face, half face, speech diaphragm or sound device, welding helmet, within a full-face mask, half face mask and typical commercial full-face mask, welding mask, helmet for sports or recreation, helmet for motor sports, helmet for other necessities and the like.

Upstream filtration may utilize a pocket mask or typical multi-layer mask by cutting a slice of the inside mask to convert mask to pocket mask and attaching ducted apparatus with baffle to either side of the front layer. (Examples of air flow not requiring second mask and the mask can be disposable surgical mask if it is multi-layered). The vent in some examples is not seen on the outside of the multi-layered mask (pocket-mask). If the mask has no pocket—slice the first layer towards the face to have a slit to allow the duct apparatus to be attached between the first layer and the other layer or layers. The duct apparatus attaches from the front layer with the baffle and the vent being on the inside of the mask and positioned together to create a bond. Therefore, the vent cannot be seen on the outside layer which is viewable to others.

In some embodiments, the techniques and designs of the disclosure may easily be retrofitted to attach to components of other embodiments, whether new or preexisting. The embodiments can be put on and not damage the material requiring no opening in the various components as air will pass through the material or others need an opening to allow the embodiments to be incorporated from the outside of the components to the inside of the components as the material will not accommodate the passage of air through to the external side of the environment.

Some embodiments may be applied to underwater scuba gear to improve the current technology of standards available at the present time.

Some embodiments may be applied to underwater snorkeling gear to improve the current technology of standards available at the present time.

Some embodiments may be applied to extreme weather gear to be improve the designs by encompassing the entire head and viewing face from the elements with the exhalation tube being utilized in an unconventional manner such as but not limited to release above head or behind the outer layer coat.

Some embodiments may be attached to various tube elements allowing for inhalation of air, such as oxygen but not limited to, and or not attached another tube for exhalation of air to be transported to a further location to enter a filtration device or not but allow the possibility of infected area to not remain in the users current location.

A respiration flow directed breathing apparatus used in conjunction with one or more but not limited to examples of the following: inspiration supply: respirator, respiration device, industrial safety equipment, mask, shield, helmet, fabric covering, inspiration supply tube, expulsion tube, other devices utilizing a wide range materials, where expiration can be directed from a user's mouth: nose: or the combination of mouth and nose, dispersed to the outside environment to reduce or eliminate cross contamination between inhaled respiration and exhaled respiration. This new apparatus may include any combination or lack of the following but not limited to: mouthpiece, ducting, shielding, baffling, diffuser, gasket, flange, adhesive, hook & loop, screw, nut, bolt, fastener, one-way valve, vent extended vent, wide range of connection methods and materials. Apparatus can be made to utilize the following four methods:

Exhaled air can be directed for providing direct air flow from a user's mouth with in the air supply through the and dispersed to the outside environment (environment can be breathable or not breathable—with additional mechanism to further disperse the flow till it reaches breathable air) to reduce or eliminate cross contamination between inhaled respiration and exhaled respiration. Device is utilized to reduce cross contamination from inhaled respiration and exhaled respiration from mouth or nose or both mouth and nose. Device can be made to utilize upstream filtration, downstream filtration or both upstream and downstream filtration or no filtration.

The apparatus reduces cross contamination between inhaled and exhaled air which may include, but not limited to; the following four methods, which improves either or both an overall performance of the respirator, outcomes desired by the user.

Tests of some embodiments exhibit heat results in a heat index test. A mask cavity heat index was measured for different mask configurations and ambient conditions. Test 1 took place at an ambient condition of 68° F. and 43% relative humidity (RH).

a. A standard NIOSH approved N95 cup shaped filtering face piece respirator equipped with the device as depicted in FIG. 1 was tested. The mask cavity heat index averaged 80° F. after 20 minutes.

b. For comparison a standard NIOSH approved N95 cup shaped filtering face piece respirator equipped with a standard exhalation valve was tested. The mask cavity heat index averaged 119° F. after 20 minutes.

c. A standard NIOSH approved N95 cup shaped filtering face piece respirator equipped with the device as depicted in FIG. 5 utilizing standard N95 filtering medium for source control was tested. The mask cavity heat index averaged 88° F. after 20 minutes.

d. For comparison a standard NIOSH approved N95 cup shaped filtering face piece respirator with no exhalation valve was tested. The mask cavity heat index averaged 130° F. after 20 minutes.

Test 2 took place at an ambient condition of 77° F. and 34% RH.

a. A standard NIOSH approved N95 cup shaped filtering face piece respirator equipped with the device as depicted in FIG. 1 was tested. The mask cavity heat index averaged 83° F. after 20 minutes.

b. For comparison a standard NIOSH approved N95 cup shaped filtering face piece respirator equipped with a standard exhalation valve was tested. The mask cavity heat index averaged 139° F. after 20 minutes.

c. A standard NIOSH approved N95 cup shaped filtering face piece respirator equipped with the device as depicted in FIG. 5 utilizing standard N95 filtering medium for source control was tested. The mask cavity heat index averaged 89° F. after 20 minutes.

d. For comparison a standard NIOSH approved N95 cup shaped filtering face piece respirator with no exhalation valve was tested. The mask cavity heat index averaged 132° F. after 20 minutes.

Test 3 took place at an ambient condition of 80° F. and 43% RH.

a. A standard NIOSH approved N95 cup shaped filtering face piece respirator equipped with the device as depicted in FIG. 1 was tested. The mask cavity heat index averaged 93° F. after 20 minutes.

b. For comparison a standard NIOSH approved N95 cup shaped filtering face piece respirator equipped with a standard exhalation valve was tested. The mask cavity heat index averaged 140° F. after 20 minutes.

c. A standard NIOSH approved N95 cup shaped filtering face piece respirator equipped with the device as depicted in FIG. 5 utilizing standard N95 filtering medium for source control was tested. The mask cavity heat index averaged 112° F. after 20 minutes.

d. For comparison a standard NIOSH approved N95 cup shaped filtering face piece respirator with no exhalation valve was tested. The mask cavity heat index averaged 138° F. after 20 minutes.

It should be noted that effects of heat index is related to surrounding ambient conditions, not related to possible outcomes when only subjected to these conditions in the mask cavity, but it allows for a comparison of possible mask comfort outcomes.

Current respirators increase the total dead air space because some exhaled air is held inside the respirator, effectively increasing dead air space within the respiratory tract. The apparatus if attached to current respirators has the possibility to show significant improvements and benefits to eliminate or reduce the dead space typically added by current respirator therefore decreasing the residual used air and significantly reducing current physiological effects.

Anatomical dead air space ("dead space") is that part of the respiratory tract not involved with gas exchange: the nasal pharyngeal area, trachea and bronchi, which serve to conduct air. ANSI Z88.2 standard in 2015 discusses why the increased dead air space added by wearing respirators lowers oxygen intake during inhalation.

Wearing a respirator increases the total dead air space because some exhaled air is held inside the respirator, effectively increasing dead air space within the respiratory tract.

Respirator dead space varies from one respirator to another, but in general a filtering face-piece respirator or a half-face reusable mask adds about 260 cc of dead air space to the respiratory system and a full-facepiece respirator adds 815 cc dead air space. Besides reduction in oxygen, another result of increasing dead air space is the buildup of carbon dioxide (CO2), which is a respiratory stimulant. Inside the facepiece, CO2 ranges in concentration from 2% to 5%. In contrast, CO2 in normal fresh air is 0.04%. Increased CO2 concentration stimulates breathing more than the lack of O2, at least initially for controlling respiration.

It is understood that the specific order or hierarchy of steps in the processes and embodiments disclosed are illustrations of exemplary approaches. Based upon design preferences, it is understood that the specific order or hierarchy of steps in the processes or design layouts may be rearranged. Further, some steps may be combined or omitted. Any accompanying method claims may present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

What is claimed is:

1. A ducted breathing apparatus comprising:

a face cover for sealing only an area including and between a nose and a mouth of a user's face;

wherein the face cover further comprises a mask cavity, and wherein the face cover further comprises a filter material;

a ducted air channel element for providing direct air flow from the mouth to an environment outside of the apparatus;

a compression nut seal ring and an air channel for providing a sealed mating connection between the ducted air channel element and the face cover;

a valve diaphragm configured to only open to expel exhalation gas from the user;

a connector seal ring is configured to support the valve diaphragm, wherein the compression nut seal ring, the air channel, and the ducted air channel element are secured to the face cover through a connection with the connector seal ring;

a vent shield connected to the connector seal ring and is configured to cover the valve diaphragm; wherein the valve diaphragm is located between the connector seal ring and the vent shield; and a heat shield being positioned between the connector seal ring and the vent shield, and the heat shield having an inner diameter and an outer diameter, the outer diameter is larger than an outermost diameter of the connector seal ring, and wherein the heat shield is further configured to shield the user from heat generated from the exhaled gas that exited from the vent shield and divert and direct the exhaled gas that exited from the vent shield away from a portion of the face cover.

2. The apparatus of claim 1, wherein the ducted air channel element is connected to the compression nut seal ring via one of friction, screw threads, or adhesives.

3. The apparatus of claim 1, wherein the connector seal ring configured for mating to the compression nut seal ring via sandwiching a portion of the face cover.

4. The apparatus of claim 1, further comprising at least one strap attached to the face cover for securing the apparatus against the user's face.

5. A ducted breathing apparatus comprising:

a face cover for sealing only an area including and between a nose and a mouth of a user's face;

wherein the face cover further comprises a mask cavity, wherein the face cover comprises a filter material;

a ducted air channel element for providing direct air flow from the mouth to an environment outside of the apparatus;

a compression nut seal ring and an air channel for providing a sealed mating connection between the ducted air channel element and the face cover, wherein the air channel comprises an external surface that is threaded;

a valve diaphragm configured to only open to expel exhalation gas from the user;

a connector seal ring is configured to support the valve diaphragm, wherein the compression nut seal ring, the air channel, and the ducted air channel element are secured to the face cover through a connection with the connector seal ring;

a vent shield connected to the connector seal ring and is configured to cover the valve diaphragm, wherein the valve diaphragm is located between the connector seal ring and the vent shield; and wherein the vent shield comprises a female threaded surface that is configured to receive and secure with a male threaded portion of the connector seal ring, wherein the connector seal ring comprises a female threaded surface configure to interface with the external threaded surface of the air channel and the female threaded surface of the connector seal ring is configured to receive a portion of the air channel, and wherein the compression nut seal is configured to engage the external threaded surface of the air channel to secure the ducted air channel element to the face cover and the connector seal ring.

6. The apparatus of claim 5, wherein the connector seal ring configured for mating to the compression nut seal ring via sandwiching a portion of the face cover.

7. The apparatus of claim 5, further comprising at least one strap attached to the face cover for securing the apparatus against the user's face.

* * * * *